US005651272A

United States Patent [19]

Peniazek

[11] Patent Number: 5,651,272

[45] Date of Patent: Jul. 29, 1997

[54] ARTICLE OF JEWELRY

[76] Inventor: Eduard L. Peniazek, 49 Mayfair Dr., Pittsburgh, Pa. 15228

[21] Appl. No.: 491,673

[22] Filed: Jun. 19, 1995

Related U.S. Application Data

[63] Continuation of Ser. No. 190,263, Feb. 2, 1994, abandoned.

[51] Int. Cl.[6] ..... A44C 5/00

[52] U.S. Cl. ..... 63/9; 63/7

[58] Field of Search ..... 63/2, 4, 7, 9; 24/116 A, 24/597, 616

[56] References Cited

U.S. PATENT DOCUMENTS

| | | | |
|---|---|---|---|
| 272,829 | 2/1883 | Cockshaw | 63/4 |
| 492,131 | 2/1893 | Adams | 24/616 |
| 1,056,074 | 3/1913 | Wallenthin | 63/7 |
| 2,172,525 | 9/1939 | Surrows . | |
| 2,255,008 | 9/1941 | Hargreaves | 63/7 |
| 5,148,689 | 9/1992 | Azrielant et al. | 63/4 |

FOREIGN PATENT DOCUMENTS

| | | | |
|---|---|---|---|
| 999 | of 1878 | United Kingdom | 63/7 |

*Primary Examiner*—Kenneth J. Dorner
*Assistant Examiner*—Jerry Redman
*Attorney, Agent, or Firm*—Darby & Darby

[57] ABSTRACT

A herringbone chain necklace is divided into a plurality of segments of conventional flexible herringbone construction, with flat hinges positioned between adjacent segments. The segments pivot about hinge axes that are perpendicular to the plane of the chain.

9 Claims, 1 Drawing Sheet

ARTICLE OF JEWELRY

This is a continuation of application Ser. No. 08/190,263, filed Feb. 2, 1994, now abandoned.

BACKGROUND OF THE INVENTION

This invention relates generally to jewelry and more particularly to a flexible necklace having an articulated construction.

A necklace is perhaps the most prominent piece of jewelry that a person wears. It may have sentimental associations for the wearer or may be considered as a fashion item to complete or complement a clothing outfit, for example, a suit or a dress. Precious metals, for example, gold, are frequently used in necklaces. The size of a necklace of precious metal, as it appears to the viewer, may give a suggestion of the monetary value of the necklace. Thus, wide necklaces, although made very thin, are often favored over narrow necklaces, as they present to the viewer a greater area or face of precious metal, and a greater impression of the monetary value of the necklace. Wide necklaces also offer opportunity for attractive designs. Resulting from these economic and aesthetic considerations, flat necklaces of minimum thickness but maximized frontal width, are common and in continuous demand.

However, a problem can arise with wide-faced necklaces, whether thick or thin, in that it may be difficult to bend such a necklace in the plane of the necklace. Thus, a wide necklace may tend not to lay properly around the neck of a wearer, there being a tendency for the necklace to curl and not lie flat against the body surface or clothing. If additionally, the necklace is thin, curling is a greater problem. This problem is resolved in better bead or pearl necklaces, for example, by the knotted connections between the individual beads or pearls. Such a necklace can be bent into any shape without any induced stresses. Similarly, link and rope-type necklaces are flexible and can be easily draped around the neck without regard to any special orientation. However, the very popular herringbone chain necklace, which has the great advantage that it can be made wide yet very thin, does not easily bend except outside the plane defined by the herringbone face or surface. As the necklace is made wider, the more difficult it becomes for the necklace to follow the contours of the wearer's body or clothing. Consequently, there is a practical limitation on the width of herringbone chain necklaces, if they are to conveniently and properly rest on the user.

What is needed is a herringbone chain necklace construction of substantial width, yet having flexibility to permit the necklace to drape properly around the neck of a user without curling or inducing unwanted stresses in the necklace itself.

SUMMARY OF THE INVENTION

Accordingly, it is an object of the invention to provide an improved necklace of the herringbone chain type that has high flexibility in the plane defined by the chain.

A further object of the invention is to provide an improved herringbone chain necklace that can reasonably bend in any direction without inducing damaging stresses in the necklace. Still another object of the invention is to provide an improved herringbone necklace that can be made in large widths and low thicknesses, and has an ability to readily bend in the plane of the herringbone chain.

Generally, in accordance with the invention, a herringbone chain necklace is divided into a plurality of segments of conventional flexible herringbone construction, with flat hinges positioned between adjacent segments. The segments pivot about hinge axes that are perpendicular to the plane of the chain. Thus, the requirements for bending the individual herringbone segments in their plane is substantially reduced, and wider necklaces, which drape properly around the neck of a user, are provided. The herringbone construction in the segments is conventional.

This invention accordingly comprises the features of construction, combination of elements and arrangement of pans, which will be exemplified in the constructions hereinafter set forth and the scope of the invention will be indicated in the claims.

DESCRIPTION OF THE PREFERRED EMBODIMENT

Figure 1:
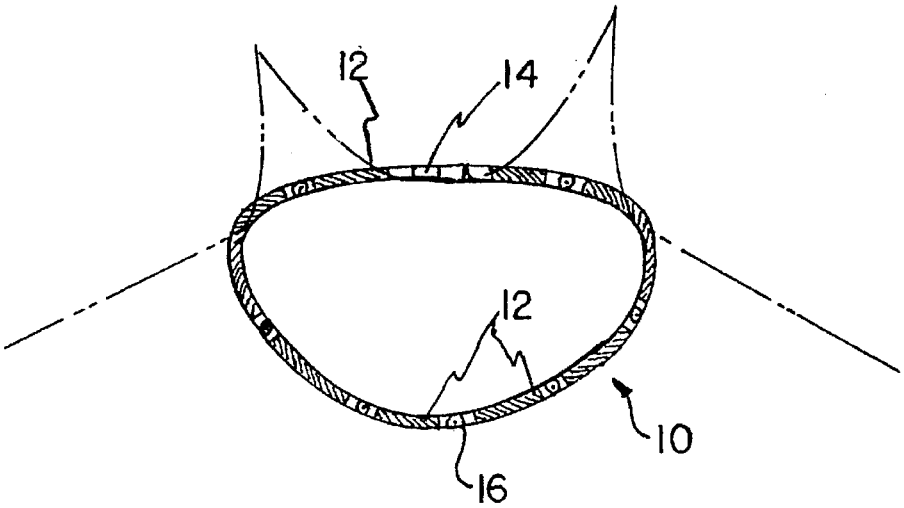
FIG. 1 is a perspective view of a herringbone chain necklace in accordance with the invention, draped around the neck of a phantom user.

With reference to the Figures, a broad-faced necklace 10 in accordance with the invention includes a plurality of segments 12 that are hingedly joined at their ends to form a complete loop that is releasibly held together by a clasp 14. A hinged connector 16 between the ends of the segments 12 allows for pivoting of adjacent segments about an axis 18.

The segments 12 are of conventional herringbone construction 20. A herringbone construction is generally flat, that is, smaller in thickness 22 than in width 24. Preferably, width 24 is at least twice thickness 22. Thus, the segments 12 are flexible and bend much more readily when the thickness 22 represents a radial dimension of the curvature than when the width 24 represents a radial direction of curvature. In other words, the herringbone segments 12 bend more readily into and out of the plane of the paper in FIG. 2 than parallel to the plane of the paper.

The hinged connector 16 includes two substantially identical hinge plates 26. Each hinge plate 26 includes a U-shaped yoke 28, into which an end 30 of an herringbone chain segment 12 is snugly received and fixedly connected, for example, by soldering using techniques known in the jewelry arts.

Figure 3:
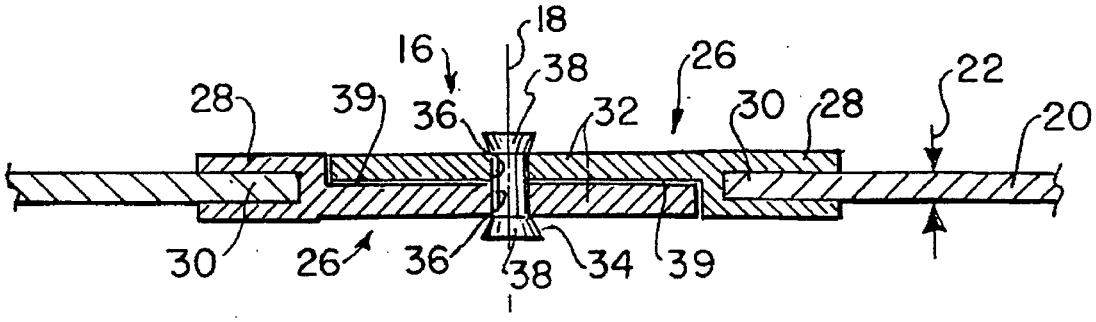
FIG. 3 is a sectional view to an enlarged scale taken along the line 3—3 of FIG. 2.

A circular disk 32 integrally connects to the yoke 28 so as to lie in a plane substantially parallel to the plane of the herringbone 20 (FIG. 3) when the necklace is flat, as illustrated in FIG. 3. Where two herringbone segments 12 are joined, each circular disk 32 is recessed into the offset of the other hinge plate 26, provided between the yoke 28 and disk 32. Thereby, a substantially flat hinged connector 16 is provided.

Figure 2:
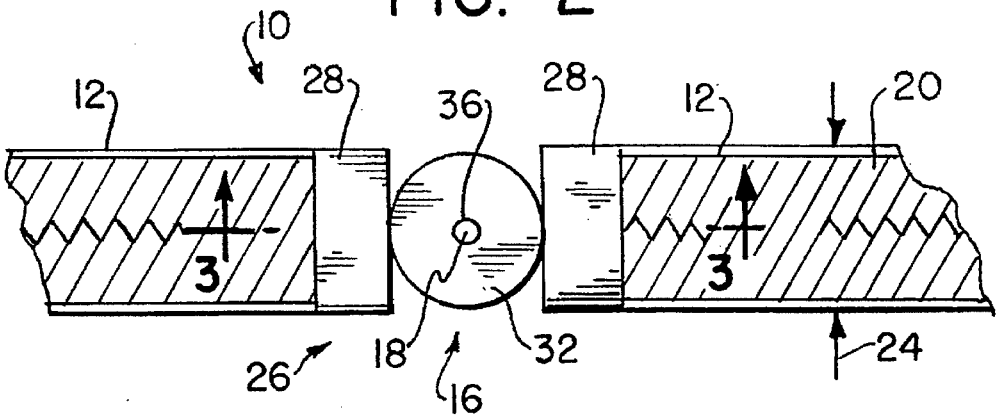
FIG. 2 is a fragmentary front elevational view of a necklace in accordance with the invention, showing a hinge between segments.

A pin 34, centered upon the pivoting axis 18, extends through the central openings 36 in the disks 32, permitting rotation of the disks 32 relative to each other without distorting the appearance of the hinged connector 16, as viewed in FIG. 2. Thus, the necklace 10 is easily curved about the axis 18 (in the plane of the drawing of FIG. 2) while maintaining the aesthetic appearance of the necklace. The pin 34 is held in place by enlargements 38 at the ends of the pin 34. Such enlargements may be made by welding or by upsetting the material after the pin has been inserted through the central openings 36.

In the illustrated embodiment, the diameter of the circular disk 32 substantially equals the width 24 of the herringbone 20. The width of the yokes 28 is the same as the width 24 of the herringbone 20. It should be understood that in alternative embodiments in accordance with the invention, these dimensions need not be substantially similar. For aesthetic reasons, different dimensions can be used for the different parts. That is, the width of the yokes (FIG. 2) can be greater than the width 24 of the herringbone or vice-versa; the diameter of the circular disks 32 need not equal the width 24 of the herringbone. Different thicknesses 22 of the herringbone 20 may be used by modifying the yoke 28, and the circular disk 32 can be replaced with plates of other contours or with scalloped edges, etc., etc. . . . The yokes 28 need not be rectangular as seen in FIG. 2 and need not have parallel branches as seen in FIG. 3. The yoke may be replaced by a flat plate to which the segment is fastened. The plates 32 need not be flat on their external surfaces, although the inner opposed bearing faces 39 are preferably flat.

Further, the segments 12 need not be of a herringbone construction or of equal length. Other weaves and constructions, where bending in the plane of the necklace (as illustrated in FIG. 2) is difficult, may be constructed in segments and joined with hinge connections in accordance with the invention. Different segments may have different weaves or constructions in the same necklace. The quantity of segments 12 and hinge connectors 16 may be determined by the designer in dependence upon the appearance that is sought.

Any clasp 14, known in the art and suitable for use with herringbone constructions may be used in a necklace 10 in accordance with the invention. Accordingly, the clasp is not discussed in any detail herein.

An articulated necklace in accordance with the invention provides a pleasing appearance and is readily arched in mutually perpendicular planes without inducing large stresses in the elements of the device. Thus, wide necklaces, including the herringbone type, can be provided that drape properly around the neck of a user.

It will thus be seen that the objects set forth above, and those made apparent from the preceding description, are efficiently attained and, since certain changes may be made in the above constructions without departing from the spirit or the scope of the invention, it is intended that all matter contained in the above description, or shown in the accompanying drawings, should be interpreted as illustrative and not in a limiting sense.

What is claimed is:

1. A necklace having a broad face said necklace, comprising:

at least a first chain segment of a flexible herringbone construction and a second chain segment of said herringbone construction, each said segment having longitudinal ends and a face surface;

at least one hinged connector, each said connector including:

a first hinge plate and a second hinge plate, said first hinge plate being fixedly connected to one longitudinal end of said first segment such that said first hinge plate does not pivot with respect to said adjoining first segment, said second hinge plate being fixedly connected to one longitudinal end of said second segment such that said second hinge plate does not pivot with respect to said second segment; and pivot means for pivotably connecting said first and second hinge plates together, a pivot axis for said hinge plates being perpendicular to said face surfaces of said first and second segments, said first and second segments being joined longitudinally with said hinged connector therebetween such that said first and second segment pivot with respect to each other without said first segment pivoting with respect to said first hinge plate and without said second segment pivoting with respect to said second hinge plate.

2. A necklace as in claim 1, wherein each of said face surfaces substantially corresponds to the area defined by the length and width of said chain segments.

3. A necklace as in claim 1, wherein said segments have thickness and width and said width is at least twice the thickness of said herringbone segment.

4. A necklace as in claim 1, further comprising at least a second hinged connector, the first hinge plate of said second connector being connected to the other longitudinal end of said first chain segment.

5. A necklace as in claim 4, further comprising at least a third chain segment of said herringbone construction, the second hinge plate of said second connector being connected to one longitudinal end of said third chain segment.

6. A necklace as in claim 1, further comprising an additional plurality of said hinged connectors and said chain segments, all of said chain segments being joined together longitudinally by said connectors to form a chain having free ends, and clasp means for releasibly joining together said free ends of said chain.

7. A necklace as in claim 1, wherein each said hinge plate includes a planar surface generally parallel to the face surfaces of said chain segments, the planar surface of said first hinge plate sliding on the planar surface of said second hinge plate when said chain segments are pivoted about said pivot axis.

8. A necklace as in claim 1, wherein the first and second hinge plates pivot solely in a plane parallel to the face surface.

9. A necklace having a broad face and being more readily bendable perpendicular to the plane of the broad face than in the plane of the broad face, said necklace comprising:

at least a first chain segment of a flexible construction and a second chain segment of said flexible construction, each said segment having longitudinal ends and a face surface;

at least one hinged connector, each said connector including:

a first hinge plate and a second hinge plate, said first hinge plate being connected to one longitudinal end of said first segment and having a comprising flat bearing face, said second hinge plate being connected to one longitudinal end of said second segment and having a comprising flat bearing face, and pivot means for pivotably connecting said first and second hinge plates together such that said first and second hinge plates ride along respective flat bearing faces, a pivot axis for said hinge plates being perpendicular to said face surfaces of said first and second segments, said first and second segments being joined longitudinally with said hinged connector therebetween.

* * * * *